United States Patent [19]

Texidor

[11] 3,979,842

[45] Sept. 14, 1976

[54] ATHLETIC SHOE EXERCISER

[75] Inventor: Genaro Texidor, New York, N.Y.

[73] Assignee: Lawrence Peska Associates, Inc., New York, N.Y. ; a part interest

[22] Filed: Dec. 23, 1975

[21] Appl. No.: 643,776

[52] U.S. Cl. ..... 36/115; 272/96; 280/11.19

[51] Int. Cl.[2] ..... A43B 5/04; A63C 17/00

[58] Field of Search ..... 36/115; 272/96, 115, 272/114, 127

[56] References Cited

UNITED STATES PATENTS

| | | | |
|---|---|---|---|
| 2,095,942 | 10/1937 | Wetterstrand | 280/11.23 |
| 2,733,065 | 1/1956 | Barkschat | 36/115 |
| 3,152,812 | 10/1964 | Cummings | 280/11.19 |

*Primary Examiner*—Patrick D. Lawson
*Attorney, Agent, or Firm*—Eugene V. Mandel

[57] ABSTRACT

An athletic shoe exerciser having means for roller assisted human locomotion. The exerciser includes means for retaining the rollers when not in use inside the lower portion of the exerciser. The exerciser also includes removable soles for various athletic applications.

9 Claims, 5 Drawing Figures

ATHLETIC SHOE EXERCISER

BACKGROUND OF THE INVENTION

This invention relates to an athletic shoe exerciser, and more particularly to an exerciser for permitting roller assisted locomotion where the rollers may be stored in the lower portion of the exerciser.

Roller exercisers in use today are only suited for one purpose. A user must provide for an alternate means of footwear as desired activities change because the roller assemblies are permanently and rigidly affixed to the upper shoe. The need for a multiplicity of footwear is costly to the user. Furthermore, it is inconvenient to have several pairs of athletic footwear.

Therefore, it is an object of this invention to provide an athletic shoe exerciser having rollers that readily can be retained inside the lower portion of the exerciser to assist human locomotion.

It is a further object of the present invention to provide an athletic shoe exerciser having indexed erecting means for the rollers.

Another object of the present invention is to provide removable soles for different athletic uses.

Still another object of the present invention is to provide an athletic shoe exerciser that may be used with various types of materials that may be found in current styles for the upper portion.

These objects, as well as other objects, of the present invention will become readily apparent after reading the description of the accompanying drawings.

SUMMARY OF THE INVENTION

An athletic shoe exerciser, according to the present invention, comprises rollers to aid in human locomotion which can be retracted into the lower portion of the exerciser and interchangeable soles to cover the rollers for various athletic uses, an upper portion adapted to receive a foot, a lower portion affixed on the underside of the upper portion, with the lower portion having a wall circumscribing the underside of the upper portion and forming a cavity, two pairs of rollers with erecting means for each pair of rollers pivotally affixed to the underside of the upper portion and adapted to be received within the cavity, and a removable sole attached to the lower portion concealing the rollers.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT

Figure 1:
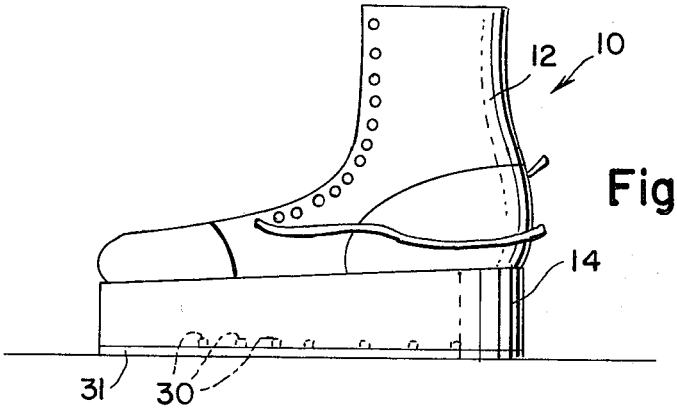
FIG. 1 is a side view of an athletic shoe exerciser incorporating the principles of the present invention.

Referring now to the Figures, and more particularly, to the embodiment illustrated in FIG. 1, showing the athletic exerciser 10 which includes an upper portion 12 and a lower portion 14 affixed thereon.

Figure 2:
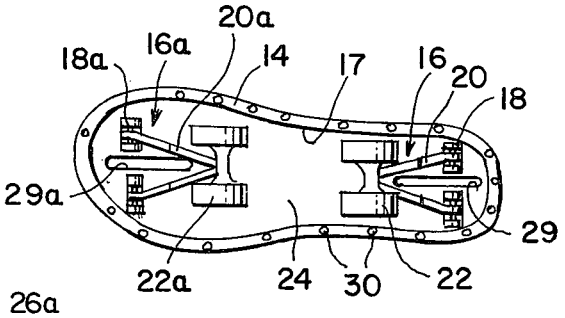
FIG. 2 is a bottom view of the preferred embodiment of the present invention showing the roller erecting means in the retracted position.

FIG. 2 shows a bottom view of the preferred embodiment of the present invention with a pair of roller erecting mechanisms 16, 16*a*, retracted within the cavity 17 formed by the lower portion 14. The erecting mechanisms 16, 16*a*, include a pivot 18, 18*a*, affixed to the bottom or underside 24 of the upper portion 12. Also included are a pair of rollers 22, 22*a* which are affixed to erecting mechanism 16, 16*a*. Portion 20, 20*a* of mechanism 16 is adapted to be guided by slot 29, 29*a* and forms a stop. The bottom edge of lower portion 14 is provided with snaps 30 which are adapted to accept mating snap mechanisms on a removable sole 31.

Figure 4:
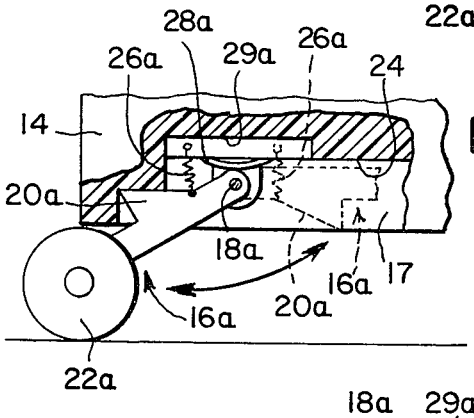
FIG. 4 is an enlarged side view of a portion of the preferred embodiment showing the erecting means locked in the extended position.
Figure 3:
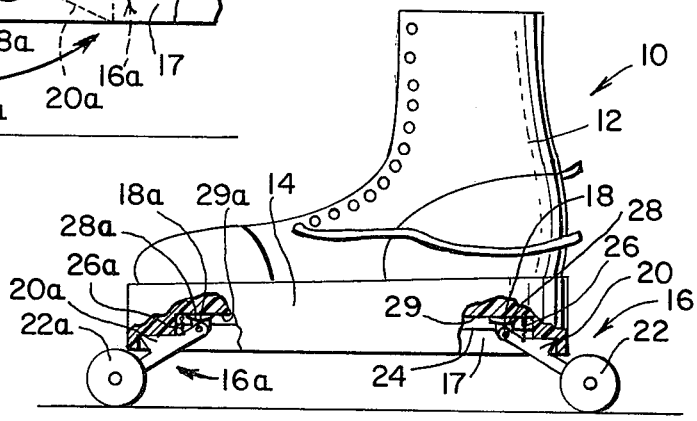
FIG. 3 is a side view of the preferred embodiment showing the roller erecting means in the usuable or extended position.

FIG. 3 is a partially broken out side view of the present invention 10 showing the erecting mechanism 16 in the roller use or extended position and positive locking device employing a coil spring 26 and a leaf spring 28 which permits positive locking in the extended and retracted positions as shown in FIG. 4. The lower portion 14 is preferably constructed of fiberglass reinforced plastic and is adapted to receive the sole 31 by means of mating snaps 30.

Figure 5:
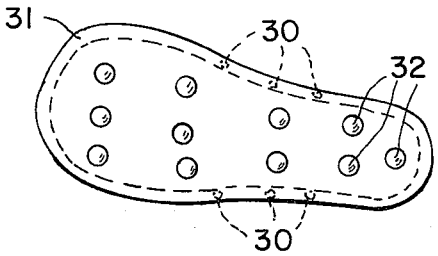
FIG. 5 is a bottom view of a removable sole assembly adapted to be retained by the lower portion of the shoe exerciser and employing cleats.

FIG. 5 is a bottom view of a typical removable sole 31 which includes cleats 32 and mating snaps 30 provided thereon.

In operation, the sole 31 is removed and the erecting mechanisms 16, 16*a* are opened to the roller use position. When rollers 22, 22*a* are no longer desired they are retracted into the cavity 17 and the removable sole 31 is snapped into position by use of snaps 30 on the lower portion 14 of the athletic shoe exerciser 10 permitting locomotion in the usual manner.

It will be understood that various changes in the details, materials, arrangement of the parts, and operating conditions which have been herein described and illustrated in order to explain the nature of this invention may be made by those skilled in the art within the principles and scope of the invention.

Having thus set forth the nature of the invention, what is claimed is:

1. An athletic shoe exerciser comprising:

a. an upper portion adapted to receive a foot;

b. a lower portion affixed to the underside of said upper portion, said lower portion comprising a wall circumscribing the underside of said upper portion and forming a cavity;

c. two pairs of rollers; and d. erecting means for each pairs of said rollers pivotally affixed to the underside of said upper portion and adapted to be received within said cavity.

2. An athletic shoe exerciser according to claim 1, further including a removable sole attached to said lower portion adapted to conceal said pairs of rollers.

3. An athletic shoe exerciser according to claim 2, wherein said removable sole comprises a resilient material.

4. An athletic shoe exerciser according to claim 2, wherein said removable sole comprises a semi-resilient material fitted with cleats.

5. An athletic shoe exerciser according to claim 1, wherein said lower portion is constructed of a rigid light weight material.

6. An athletic shoe exerciser according to claim 1, wherein said erecting means provides at least two indexing positions.

7. An athletic shoe exerciser according to claim 6, wherein said erecting means includes a coil spring, a leaf spring, and a stop.

8. An athletic shoe exerciser according to claim 1, wherein said upper portion comprises a cloth material.

9. An athletic shoe exerciser according to claim 1, wherein said upper portion comprises a semi-rigid material.

* * * * *